US010718142B1

(12) United States Patent
Amerling et al.

(10) Patent No.: US 10,718,142 B1
(45) Date of Patent: Jul. 21, 2020

(54) CARRYING TRAYS AND METHODS FOR TRANSPORTING AND INSTALLING LATCHING ASSEMBLIES ON COWLINGS FOR MARINE DRIVES

(71) Applicant: Brunswick Corporation, Mettawa, IL (US)

(72) Inventors: Steven J. Amerling, Fond du Lac, WI (US); John A. Groeschel, Theresa, WI (US)

(73) Assignee: Brunswick Corporation, Mettawa, IL (US)

( * ) Notice: Subject to any disclaimer, the term of this patent is extended or adjusted under 35 U.S.C. 154(b) by 243 days.

(21) Appl. No.: 15/866,574

(22) Filed: Jan. 10, 2018

(51) Int. Cl.

| | |
|---|---|
| ***E05C 19/00*** | (2006.01) |
| ***E05C 3/16*** | (2006.01) |
| ***E05B 73/00*** | (2006.01) |
| ***B63H 20/32*** | (2006.01) |

(52) U.S. Cl.
CPC ..... *E05C 19/009* (2013.01); *B63H 20/32* (2013.01); *E05B 73/0076* (2013.01); *E05C 3/162* (2013.01)

(58) Field of Classification Search
CPC ..... B63H 20/32; B63H 2020/323; B63H 2020/326; B25H 3/04; B25H 3/06; B60R 11/00; B60R 2011/0001; B60R 2011/0042; B60R 2011/0049; B60R 2011/005; B60R 2011/0052; E05B 73/007; E05B 73/0076; E05C 19/009; E05C 3/162; Y10T 29/53; Y10T 29/53004
See application file for complete search history.

(56) References Cited

U.S. PATENT DOCUMENTS

| | | | |
|---|---|---|---|
| 2,549,483 | A | 4/1951 | Kiekhaefer |
| 2,549,485 | A | 4/1951 | Kiekhaefer |
| 3,773,010 | A | 11/1973 | Elingsen |
| 4,348,194 | A | 9/1982 | Walsh |
| 4,600,396 | A | 7/1986 | Crane et al. |
| RE32,620 | E | 3/1988 | Iwai |
| 4,832,641 | A | 5/1989 | Oishi et al. |
| 4,844,031 | A | 7/1989 | Boda et al. |

(Continued)

FOREIGN PATENT DOCUMENTS

| | | |
|---|---|---|
| JP | 4024192 | 1/1992 |
| JP | 4231286 | 8/1992 |

OTHER PUBLICATIONS

Fuel-Door-Full_Open.jpg, http://www.iamaudi.com/img/Fuel-Door-Open, website visited Jul. 9, 2015.

*Primary Examiner* — Ajay Vasudeva
(74) *Attorney, Agent, or Firm* — Andrus Intellectual Property Law, LLP

(57) ABSTRACT

A carrying tray facilitates installation of a latching assembly on a cowl of a marine drive. The carrying tray comprises a plurality of latching device cavities configured to retain a plurality of latching devices in a spaced-apart orientation that positions each respective latching device with respect to its mounting position on the cowl so that the respective latching device can be directly installed onto the cowl without tangling or damaging the flexible connectors, and an actuator retainer that retains an actuator in a position with respect to its mounting position on the cowl so that the actuator can be directly installed onto the cowl without tangling or damaging the flexible connectors.

13 Claims, 8 Drawing Sheets

(56) References Cited

U.S. PATENT DOCUMENTS

| | | | | |
|---|---|---|---|---|
| 4,875,883 | A | 10/1989 | Slattery | |
| 4,927,194 | A | 5/1990 | Wagner | |
| 5,102,358 | A | 4/1992 | Binversie | |
| 5,120,248 | A | 6/1992 | Daleiden et al. | |
| 5,263,884 | A * | 11/1993 | Oishi | B63H 20/32 123/195 P |
| 5,509,836 | A | 4/1996 | Ogasawara et al. | |
| 5,868,591 | A | 2/1999 | Kleeman | |
| 6,059,619 | A | 5/2000 | Nozue | |
| 6,390,865 | B1 | 5/2002 | Kameoka | |
| 6,488,552 | B2 | 12/2002 | Kitsu et al. | |
| 6,669,517 | B1 | 12/2003 | Alby et al. | |
| 6,682,379 | B1 | 1/2004 | Walczak et al. | |
| 6,899,579 | B1 | 5/2005 | Bruestle | |
| 6,910,429 | B1 * | 6/2005 | Matay | B25H 3/06 108/152 |
| 7,201,623 | B1 | 4/2007 | Krupp et al. | |
| 7,210,973 | B2 | 5/2007 | Sanschagrin et al. | |
| 7,246,449 | B2 * | 7/2007 | Pierson | E05B 17/06 33/194 |
| 7,267,592 | B1 | 9/2007 | Ingebritson et al. | |
| 7,448,928 | B2 | 11/2008 | Hasegawa et al. | |
| 7,621,791 | B2 | 11/2009 | Yazaki et al. | |
| 7,704,109 | B2 * | 4/2010 | Arai | B63H 20/32 440/76 |
| 9,580,943 | B1 | 2/2017 | Amerling et al. | |
| 9,580,947 | B1 | 2/2017 | Amerling et al. | |
| 10,161,168 | B1 * | 12/2018 | VanRuiswyk | E05B 53/005 |
| 2003/0054708 | A1 | 3/2003 | Yoshioka et al. | |

* cited by examiner

CARRYING TRAYS AND METHODS FOR TRANSPORTING AND INSTALLING LATCHING ASSEMBLIES ON COWLINGS FOR MARINE DRIVES

FIELD

The present disclosure relates to marine drives and more particularly to carrying trays and methods for transporting and installing latching assemblies on cowlings for marine drives.

BACKGROUND

The following US patents are incorporated herein by reference:

U.S. Pat. No. 9,580,947 discloses a cowl for an outboard marine propulsion device having an internal combustion engine. The cowl comprises a first cowl portion; a second cowl portion that mates with the first cowl portion to enclose the internal combustion engine; a service door on the second cowl portion, wherein the service door is position-able in an open position and in a closed position; and a carrying handle on the second cowl portion. The carrying handle is accessible when the service door is in the open position and inaccessible when the service door is in the closed position. A plurality of latches is spaced apart around the perimeter. The latches latch the second cowl portion to the first cowl portion. An actuator assembly actuates each of the plurality of latches. The actuator assembly can be actuated by movement of the carrying handle.

U.S. Pat. No. 9,580,943 discloses a latching device for a cowl on an outboard marine engine. The cowl has first and second cowl portions that are separated from each other in an open cowl position and latched together by the latching device in a closed cowl position. A retainer is adapted to be fixed to the first cowl portion and a latch is adapted to be fixed to the second cowl portion. The latch is movable into and between a latched position in which the latch is latched to the retainer and an unlatched position in which the latch is unlatched from the retainer. The latch comprises an engagement member, a bell crank, and a spring that is coupled to the engagement member and the bell crank. Movement of the bell crank with respect to the engagement member generates an over-center force on the engagement member that facilitates latching and unlatching of the engagement member and the retainer.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A carrying tray facilitates installation of a latching assembly on a cowl of a marine drive. The cowl has an upper cowl portion that mates with a lower cowl portion to enclose the marine drive. The latching assembly comprises a plurality of latching devices configured to latch and unlatch the lower cowl portion to the upper cowl portion, an actuator that actuates the plurality of latching devices, and a plurality of flexible connectors that operatively couples the plurality of latching devices to the actuator. The carrying tray comprises a plurality of latching device cavities configured to retain a plurality of latching devices in a spaced-apart orientation that positions each respective latching device with respect to its mounting position on the cowl so that the respective latching device can be directly installed onto the cowl without tangling or damaging the flexible connectors, and an actuator retainer that retains the actuator in a position with respect to its mounting position on the cowl so that the actuator can be directly installed onto the cowl without tangling or damaging the flexible connectors.

DETAILED DESCRIPTION OF THE DRAWINGS

Figure 1:
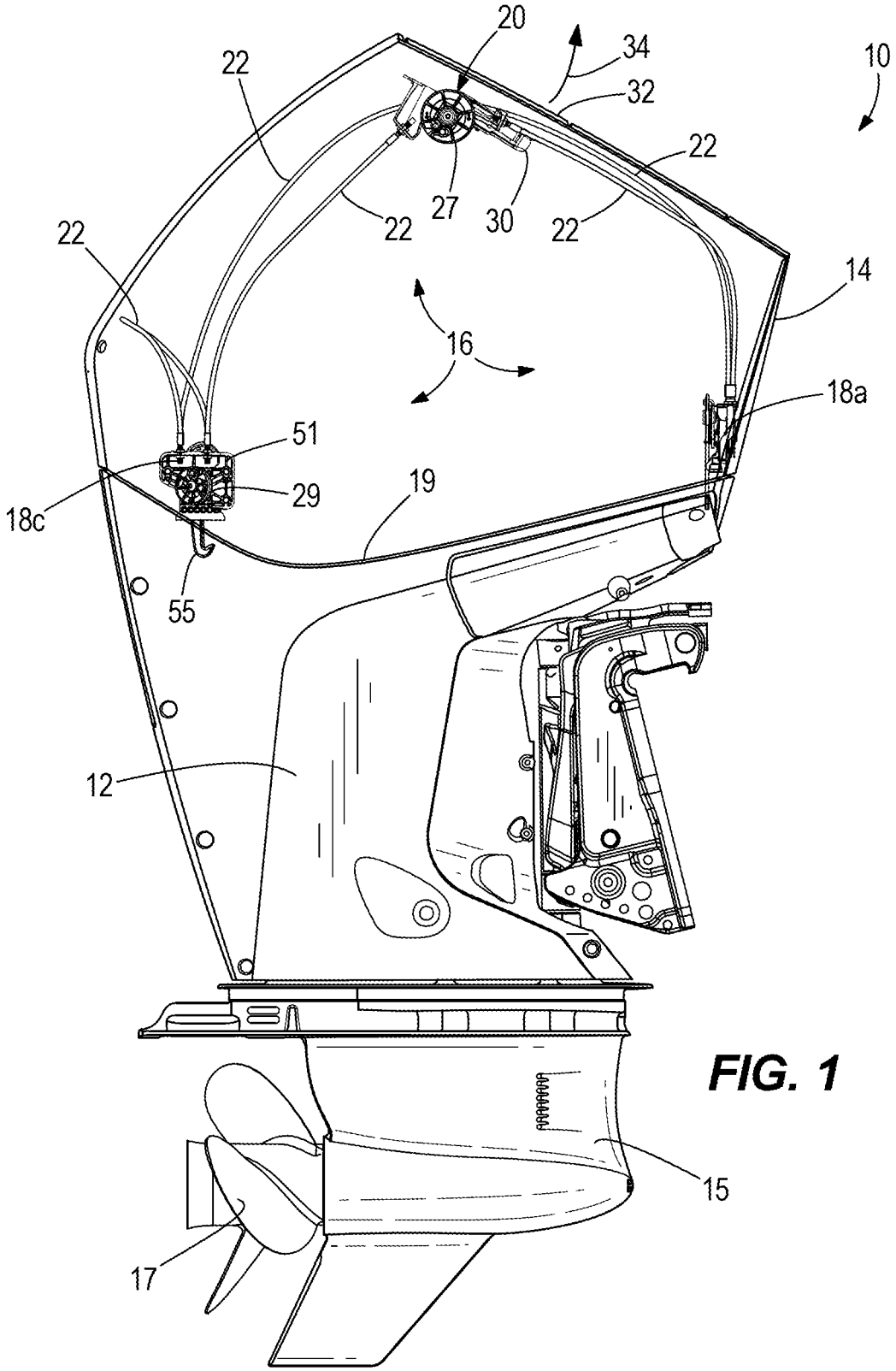
FIG. 1 is a perspective view of an exemplary marine drive having a cowl and latching assembly according to the present disclosure.

FIG. 1 depicts an exemplary marine drive 10 for propelling a marine vessel in water. The marine drive 10 has a lower cowl portion 12 or chaps and an upper cowl portion 14 or top cowl that is mated with the lower cowl portion 12 to enclose, for example, an engine, such as an internal combustion engine. As is conventional, operation of the engine causes rotation of a driveshaft that vertically extends from the engine through the lower cowl portion 12 and to a gear case 15. The gear case 15 contains a gear set for transmitting rotation of the driveshaft to a propeller 17.

Figure 2:
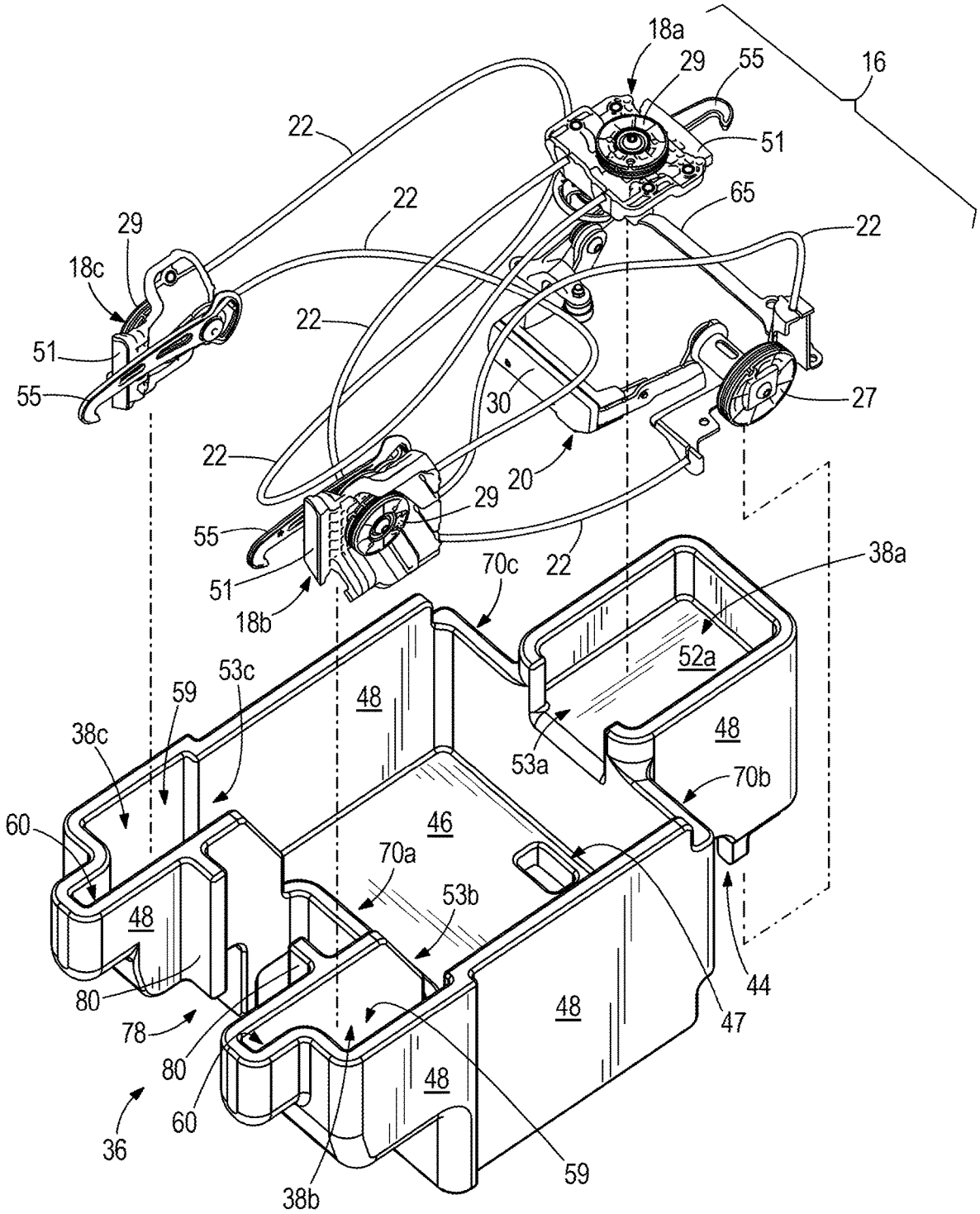
FIG. 2 is an exploded perspective view of the latching assembly and a carrying tray that facilitates transport and installation of the latching assembly on the cowl.

FIGS. 1 and 2 also depict a latching assembly 16 for latching the upper cowl portion 14 to the lower cowl portion 12 in the mated position shown in FIG. 1. Like the latching arrangements disclosed in the incorporated U.S. Pat. Nos. 9,580,943 and 9,580,947, the latching assembly 16 includes a plurality of latching devices 18*a*, 18*b*, 18*c* that are configured to latch and unlatch the upper cowl portion 14 with respect to the lower cowl portion 12. The number and configuration of the latching devices 18*a*, 18*b*, 18*c* can vary from that which is shown. The latching devices 18*a*, 18*b*, 18*c* are mounted on and spaced apart around a perimeter 19 of the upper cowl portion 14, each one being moveable into and between a latched position (FIG. 1) in which the latching device 18*a*, 18*b*, 18*c* is latched to a corresponding retainer (not shown) on the lower cowl portion 12 and an unlatched position in which the latching device 18*a*, 18*b*,

18*c* is unlatched from the retainer, all as disclosed in the above-incorporated U.S. Patents.

The latching assembly 16 also has an actuator 20 which is configured to actuate the latching devices 18*a*, 18*b*, 18*c* via a plurality of flexible connectors 22. Each flexible connector 22 has a first end coupled to either the actuator 20 or a respective latching device 18*a*, 18*b*, 18*c* and a second end coupled to either the actuator 20 or to another latching device 18*a*, 18*b*, 18*c*. The actuator 20, the plurality of flexible connectors 22, and the plurality of latching devices 18*a*, 18*b*, 18*c* are connected together in a pull-pull, "daisy-chain" arrangement, i.e., where actuation of the actuator 20 actuates all of the latching devices 18*a*, 18*b*, 18*c* in the plurality. Specifically, actuation of the actuator 20 rotates a pulley 27 on the actuator 20, which pulls on a respective flexible connector 22 to thereby rotate a corresponding pulley 29 on a first one of the respective latching devices 18*a*, 18*b*, 18*c* which pulls on the next flexible connector 22 in the chain to pull on a corresponding pulley 29 on a next one of the respective latching devices 18*a*, 18*b*, 18*c*, etc., all as is disclosed in the above-incorporated U.S. Patents.

The actuator 20 includes a carrying handle 30 disposed in a pocket formed in the upper cowl portion 14. The pocket is covered by a service door 32, which is manually pivotable, as shown by arrow 34, from the closed position shown in FIG. 1 in which the carrying handle 30 is covered to an open position in which the carrying handle 30 is exposed for use. Once the service door 32 is moved into the open position, the carrying handle 30 is manually pivotable from the retracted position shown in FIG. 1 to an extended position, in which the carrying handle 30 extends from the noted pocket. Pivoting of the carrying handle 30 rotates the pulley 27, thus actuating the latching devices 18*a*, 18*b*, 18*c* via the flexible connectors 22 and pulleys 29, all as summarized above and more fully described in U.S. Pat. No. 9,580,947.

The actuator 20 is operatively connected to each of the latching devices 18*a*, 18*b*, 18*c* via the flexible connectors 22. The flexible connectors 22 connect each of the pulleys 27, 29 together in the above described pull-pull, daisy-chain arrangement wherein pivoting of the carrying handle 30 from the retracted position to the extended position rotates the pulley 27, which pulls on one side of the chain of flexible connectors 22 and causes corresponding rotation of the pulleys 29 connected to the respective latching devices 18*a*, 18*b*, 18*c*. Pivoting of the carrying handle 30 from the extended position to the retracted position oppositely rotates the pulley 27, thus pulling on the opposite side of the chain of flexible connectors 22 and causing opposite rotation of the pulleys 29.

During use and experimentation, the present inventors realized that it would be advantageous to provide a method and means for safely transporting the latching assembly 16 prior to its mounting on the marine drive. Since the latching assembly 16 does not have a central lifting location, the various flexible connectors 22 can often become tangled during transport. Also, in some cases, the flexible connectors 22 can become kinked during transport, which can negatively impact their functionality. The latching devices 18*a*, 18*b*, 18*c* can also inadvertently become damaged during transport. Also, during installation, the surfaces of the upper cowl portion 14 can become damaged, e.g., scratched or dented, for example if components of the latching assembly 16 are accidentally dropped.

During use and experimentation, the present inventors have also realized that it would be advantageous to provide a method and means for transporting the latching assembly 16 in a way that facilitates easier installation on the marine drive 10, i.e., in a way that limits the possibility that the installer incorrectly installs the latching devices 18*a*, 18*b*, 18*c*, for example in an incorrect location or orientation on the upper cowl portion 14, or incorrectly installs the actuator 20, for example in an incorrect location or orientation on the upper cowl portion 14, or installs the latching devices 18*a*, 18*b*, 18*c* and/or actuator 20 in a manner that kinks or stretches or otherwise damages the flexible connectors 22.

It was upon the above-described realizations that the present inventors invented the apparatuses and methods described herein below and set forth in the following claims.

Figure 3:
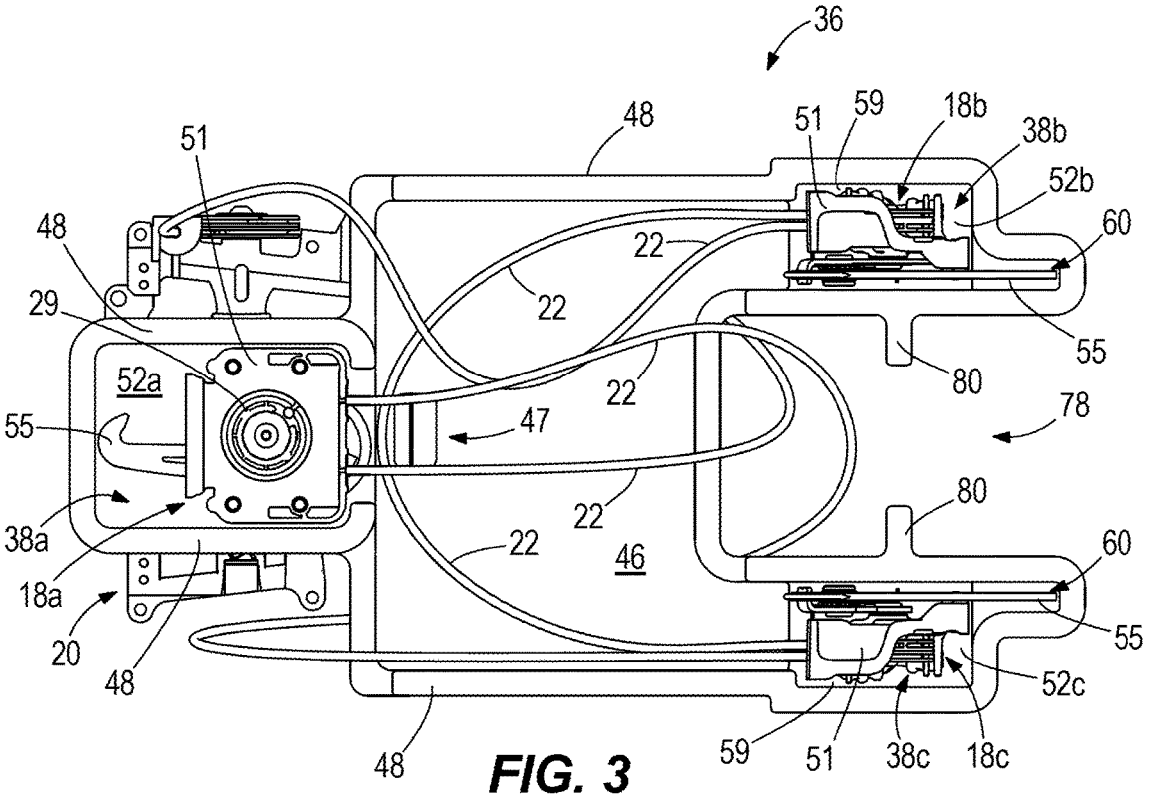
FIG. 3 is a top view of the latching assembly in the carrying tray.
Figure 4:
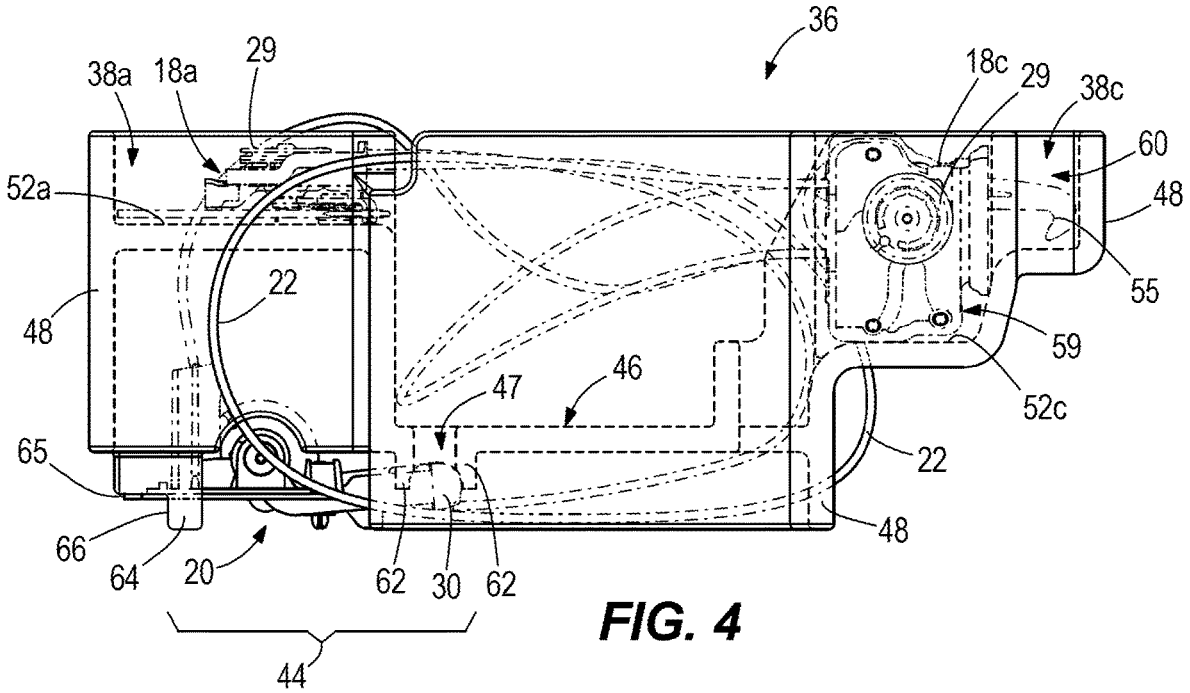
FIG. 4 is a side view of what is shown in FIG. 3.

Referring now to FIGS. 2-4, a carrying tray 36 is specially configured to facilitate safe transport of the latching assembly 16 and accurate installation of the latching assembly 16 onto the upper cowl portion 14 of the marine drive 10. The carrying tray 36 has a plurality of latching device cavities 38*a*, 38*b*, 38*c* that are each configured to retain a respective latching device 18*a*, 18*b*, 18*c* in the spaced apart orientation shown in FIG. 3. Each latching device cavity 38*a*, 38*b*, 38*c* advantageously positions a respective latching device 18*a*, 18*b*, 18*c* with respect to its intended mounting position on the upper cowl portion 14 so that the latching devices 18*a*, 18*b*, 18*c* can be directly installed onto the upper cowl portion 14 without tangling or damaging the flexible connectors 22, as will be further explained herein below. The carrying tray 36 also has an actuator retainer 44 that advantageously retains the actuator 20 in a position with respect to its mounting position on the upper cowl portion 14 so that the actuator 20 can be directly installed onto the upper cowl portion 14 without tangling or damaging the flexible connectors 22, as will be further described herein below. Each of the latching device cavities 38*a*, 38*b*, 38*c* and actuator retainer 44 are spaced apart from each other at a distance that is sufficient to prevent kinking of the flexible connectors 22 during storage and transport of the latching assembly 16 via the carrying tray 36. As shown in FIGS. 3 and 4, the distance between the respective latching device cavities 38*a*, 38*b*, 38*c* and actuator retainer 44 is sufficient to maintain a minimum radius of curvature in the respective flexible connectors 22 so as to prevent kinking or other damage from extreme bending of the flexible connectors 22.

The carrying tray 36 has a central base wall 46 and a plurality of side walls 48 that extend upwardly and downwardly from the central base wall 46 and also define an outer extent of the respective latching device cavities 38*a*, 38*b*, 38*c* and the actuator retainer 44. The central base wall 46 has an upwardly facing top surface and a downwardly facing bottom surface. Upper base walls 52*a*, 52*b*, 52*c* are provided for each of the respective latching device cavities 38*a*, 38*b*, 38*c* each having an upwardly facing top surface that provides a base for a respective latching device cavities 38*a*, 38*b*, 38*c*.

As shown in FIGS. 3 and 4, each of the latching devices 18*a*, 18*b*, 18*c* is retained in a respective latching device cavity 38*a*, 38*b*, 38*c*. The latching device cavity 38*a* is generally rectangular-shaped and sized to retain the latching device 18*a* in a face-up orientation, as shown in FIG. 3. The latching device cavities 38*b*, 38*c* are narrower than the latching device cavity 38*a*. As shown in FIG. 3, the latching device cavities 38*b*, 38*c* are sized and configured to retain the latching devices 18*b*, 18*c* in a sideways orientation. Each of the second and third latching device cavities 38*b*, 38*c* have a generally rectangular-shaped body portion 59 and a narrower, generally rectangular-shaped head portion 60 that is narrower than the body portion 59. The body portion 59 is sized to retain the mounting bracket 51 and pulley 29 of the respective latching devices 18*b*, 18*c*. The head portion 60 is sized to retain the hook portion 55 of the respective latching devices 18*a*, 18*b*.

Referring to FIG. 2, each of the latching device cavities 38*a*, 38*b*, 38*c* have inwardly facing channels 53*a*, 53*b*, 53*c* that are devoid of side walls 48 so that the installer can manually insert their finger into the respective latching device cavity 38*a*, 38*b*, 38*c* from the open interior of the carrying tray 36 and easily lift the respective latching device 18*a*, 18*b*, 18*c* out of the respective latching device cavity 38*a*, 38*b*, 38*c*. The inwardly facing channels 53*a*, 53*b*, 53*c* also allow passage of the flexible connectors 22, thus preventing bending or kinking. As further described herein below, the inwardly facing channels 53*a*, 53*b*, 53*c* also facilitate stacking of the carrying tray 36 with respect to other similarly configured carrying trays without interference from the flexible connectors 22. In cases where the latching device 18*a*, 18*b*, 18*c* is frictionally engaged with the side walls 48, the frictional force is easily overcome with manual lifting force. As described further herein below, the respective orientations of the latching device 18*a* and latching devices 18*b*, 18*c* facilitates easier and safer installation of the latching device 18*a* on a forward or aftward side of the upper cowl portion 14 and the latching devices 18*b*, 18*c* on port and starboard sides of the upper cowl portion 14, respectively, without tangling or kinking of the respective flexible connectors 42 and protecting the surrounding components from damage.

Figure 6:
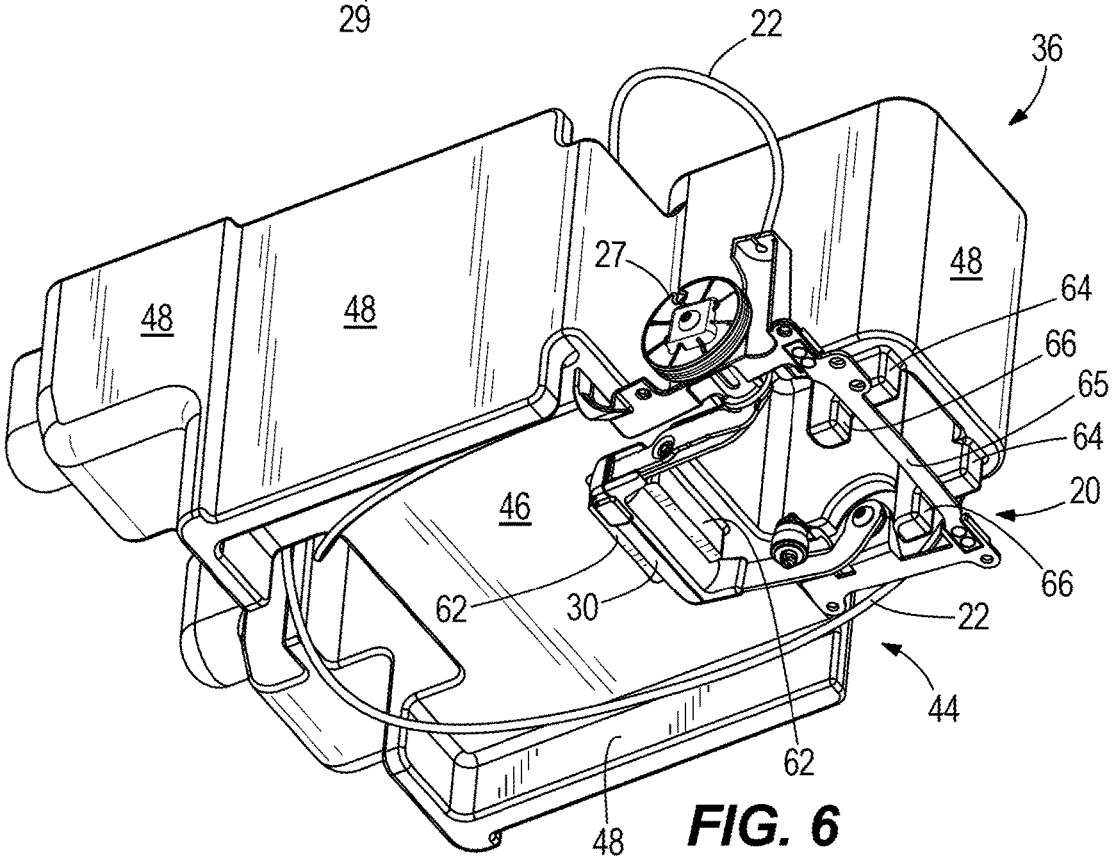
FIG. 6 is a bottom perspective view of what is shown in FIG. 3.

Referring to FIG. 4, the central base wall 46 has an aperture 47 that extends through the central base wall 46 to the actuator retainer 44. The aperture 47 is configured (i.e., located and sized) to facilitate manually pushing (via for example the installer's finger or thumb) of the actuator 20 out of the actuator retainer 44 (see arrow 61 in FIG. 10) when the carrying tray 36 is rested on a support surface, such as the inside of the upper cowl portion 14, as will be described further herein below. Referring to FIGS. 4 and 6, handle retaining members 62 extend downwardly from the central base wall 46 and are configured to engage with and frictionally retain the carrying handle 30 of the actuator 20 in the actuator retainer 44 in the face-down orientation shown in FIG. 6. The handle retaining members 62 are spaced apart by a distance sufficient for the carrying handle 30 to be wedged in between the handle retaining members 62, at the location of the aperture 47, in a friction fit. Abutment members 64 extend from the periphery of the side walls 48 and are configured to engage with the mounting bracket 65 of the carrying handle 30. The abutment members 64 can be integrally formed with the side walls 48 and have a bearing surface 66 that faces away from the handle retaining members 62 and is spaced apart from the handle retaining members 62 by a distance sufficient to cause the mounting bracket 65 to frictionally engage with the bearing surface 66 when the mounting bracket 65 is engaged with the carrying handle 30. The configuration of the handle retaining members 62 and abutment members 64 can vary from what is shown. To install the actuator 20 into the carrying tray 36, the mounting bracket 65 is engaged with the bearing surfaces 66. Then the actuator 20 is pivoted towards the central base wall 46 until the carrying handle 30 is wedged between the handle retaining members 62, as shown. As explained above, the actuator 20 is removable from the position shown in FIG. 6 by manually pushing on the actuator 20 via the aperture 47 in the central base wall 46 and overcoming the frictional engagement between the actuator 20 and the handle retaining members 62.

Figure 5:
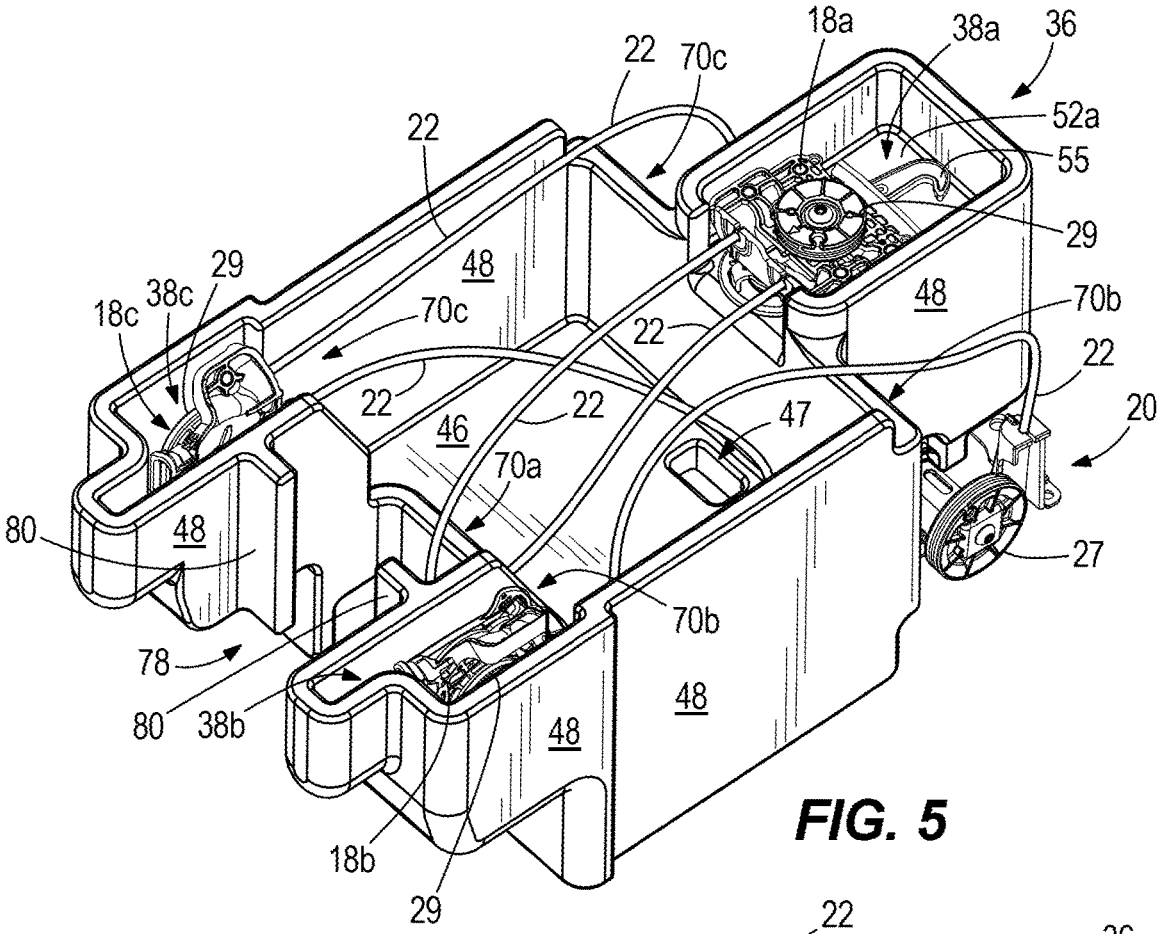
FIG. 5 is a top perspective view of what is shown FIG. 3.

Referring to FIG. 4, the latching devices cavities 38*a*, 38*b*, 38*c* are located on the opposite side of the central base wall 46 with respect to the actuator retainer 44. Thus when the latching assembly 16 is retained in the carrying tray 36, the flexible connectors 22 extend from the respective latching devices 18*a*, 18*b*, 18*c* to the actuator 20 around the side walls 48 and to the actuator 20 located in the actuator retainer 44. This configuration enables a relatively large distance between the various components in the carrying tray 36, thus maintaining a relatively large radius of curvature of the flexible connectors 22 and limiting the chances that the flexible connectors 22 become kinked. Referring to FIGS. 2 and 5, the carrying tray 36 has a central channel 70*a* between the second and third latching device cavities 38*b*, 38*c* wherein the side walls 48 are lowered or omitted to permit passage of the flexible connectors 22 from the latching device 18*a* to the actuator 20. The carrying tray 36 also has channels 70*b*, 70*c* on opposite sides of first latching device cavity 38*a*, wherein the side walls 48 are lowered or omitted to permit passage of the flexible connectors 22 from the latching devices 18*b*, 18*c* to the actuator 20, all as shown in FIG. 3. This also permits stacking of the carrying tray 36 with other similarly configured carrying trays 36 during shipment, without interference from the flexible connectors 22, as will be described herein below.

Figure 12:
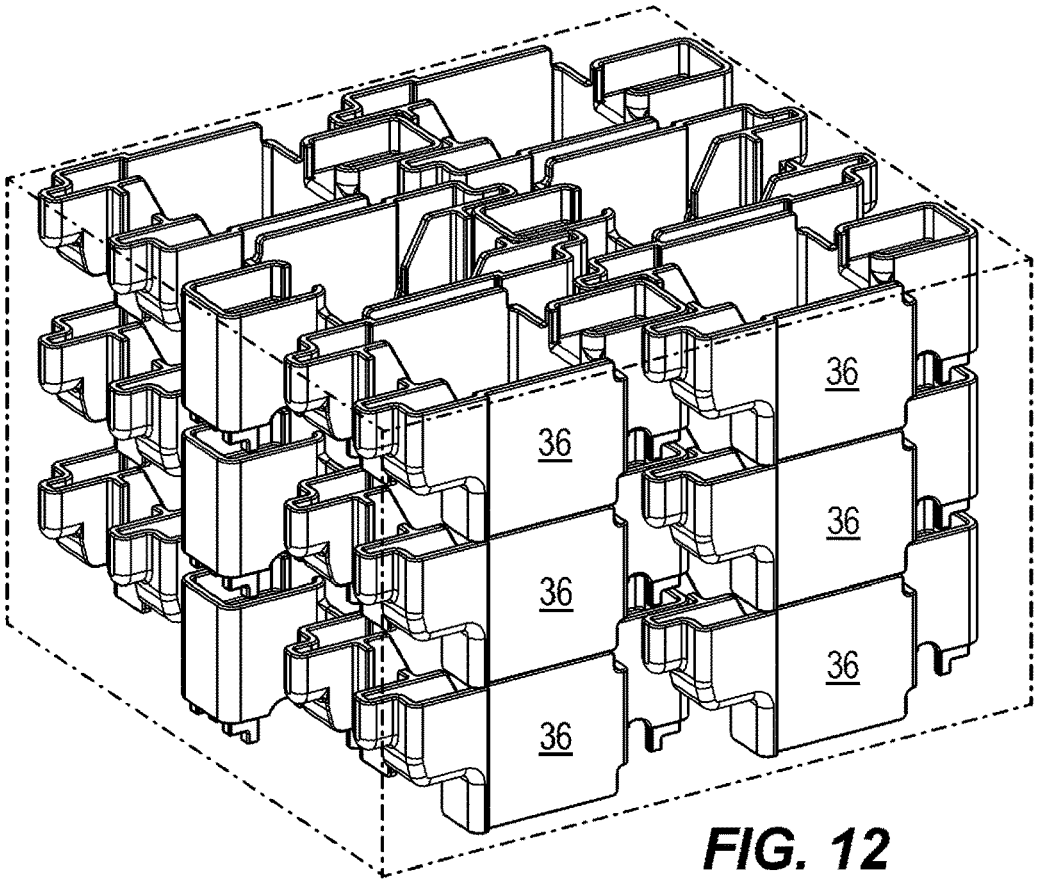
FIG. 12 is a perspective view showing a plurality of carrying trays arranged in a stacked configuration for transport.
Figure 13:
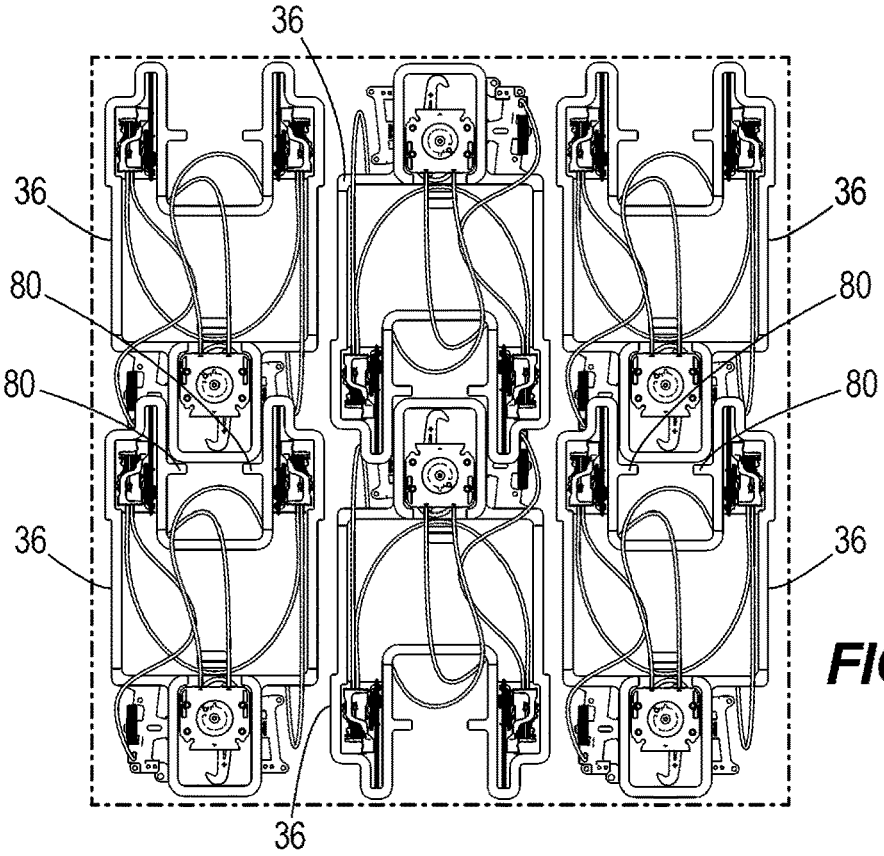
FIG. 13 is a top view of what is shown in FIG. 13.

Referring now to FIGS. 12 and 13, the carrying tray 36 is advantageously configured for transport along with a plurality of similarly configured carrying trays 36 in vertical stacks and horizontal rows. Each carrying tray 36 is stackable onto a vertically lower carrying tray 36, as shown in FIG. 12. Each carrying tray 36 is also nestable in an end-to-end relationship with a horizontally adjacent carrying tray, as shown in FIGS. 12 and 13. Referring to FIGS. 4 and 12, the lower surfaces of side walls 48 are configured to rest on top of the upper surfaces of the side walls 48 in a supporting carrying tray 36. Referring to FIGS. 3 and 13, the side walls 48 surrounding the latching device cavity 38*a* fit in the space 78 between the sidewalls defining the latching device cavities 38*b*, 38*c*. Abutment walls 80 extend into the space 78 and are engaged by the side wall of the latching device cavity 38*a* to properly position (nest) the carrying tray 36 into the space 78 of the adjacent carrying tray 36. The inwardly facing channels 53*a*, 53*b*, 53*c* and the channels 78*a*, 70*b*, 70*c* provide spaces for the flexible connectors 22 below the top of the side walls 48 so that the flexible connectors 22 do not interfere with stacking. Although FIGS. 12 and 13 only show 18 carrying trays 36 in a stacked and nested three-by-three-by-three arrangement, it will be understood that the number or carrying trays 36 can vary. Thus the carrying trays 36 advantageously provide a modular arrangement that can accommodate different shipping requirements.

Figure 7:
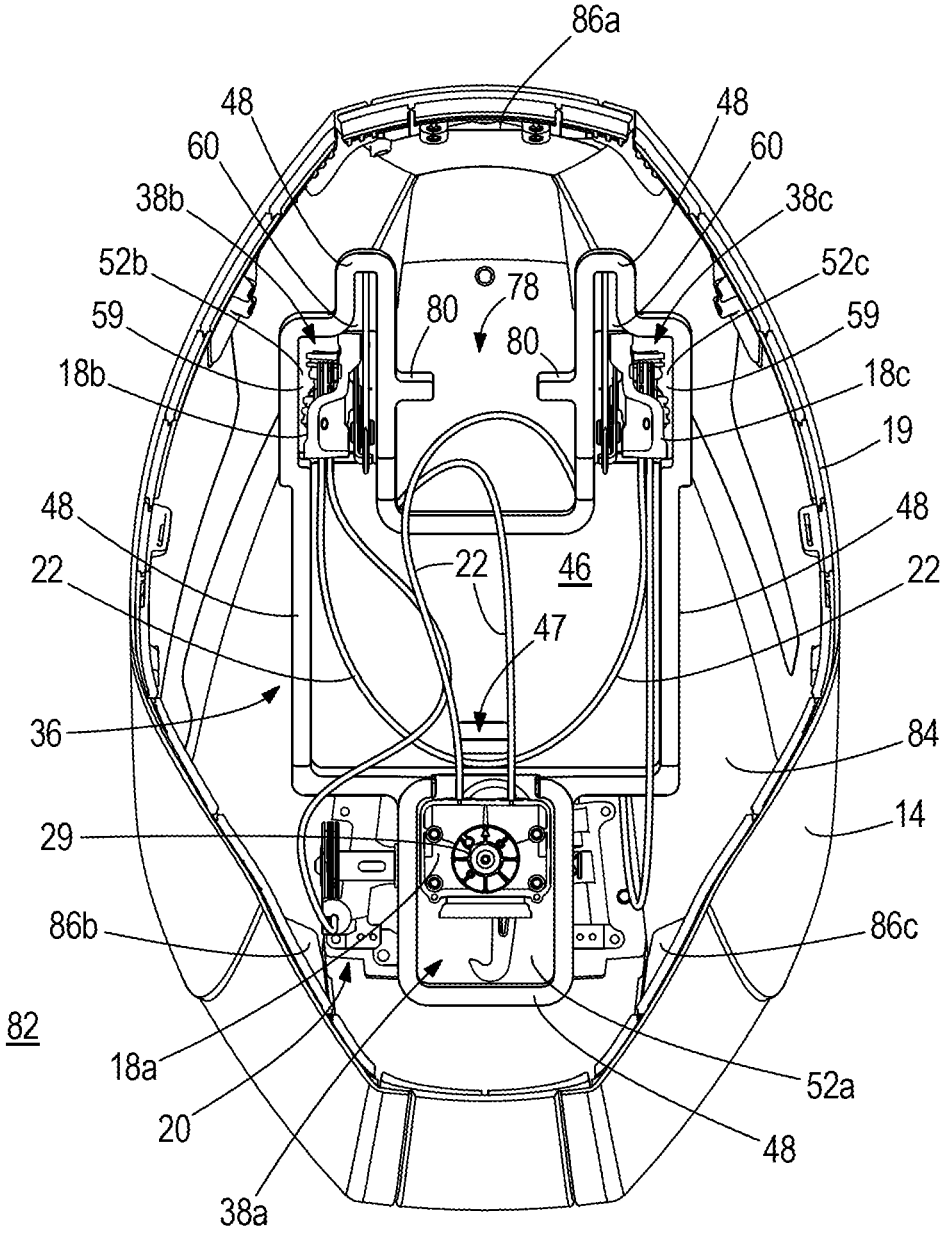
FIG. 7 is a view of the latching assembly and carrying tray located inside an upper cowl portion that is inverted and resting on a supporting surface.

FIGS. 7-11 sequentially depict installation of the latching assembly 16 on to the upper cowl portion 14 of the marine drive 10. Referring to FIG. 7, the upper cowl portion 14 is inverted and placed top-down on a support surface 82 such that the outer top surface of the upper cowl portion 14 faces the support surface 82. The upper cowl portion 14 has an interior surface 84 that extends generally upwardly, away from the support surface 82 and service door 32 to the perimeter 19. A plurality of mounting fixtures 86*a*, 86*b*, 86*c* are formed in or coupled to the interior surface 84 proximate the perimeter 19 and provide mounting positions for the respective latching devices 18*a*, 18*b*, 18*c*. Mounting fixture 86*a* is located on a forward side of the upper cowl portion 14. Mounting fixture 86*b* is located on a starboard side of the upper cowl portion 14. Mounting fixture 86*c* is located on a port side of the upper cowl portion 14. The forward side of the upper cowl portion 14 extends generally transversely to the starboard and port sides.

Figure 8:
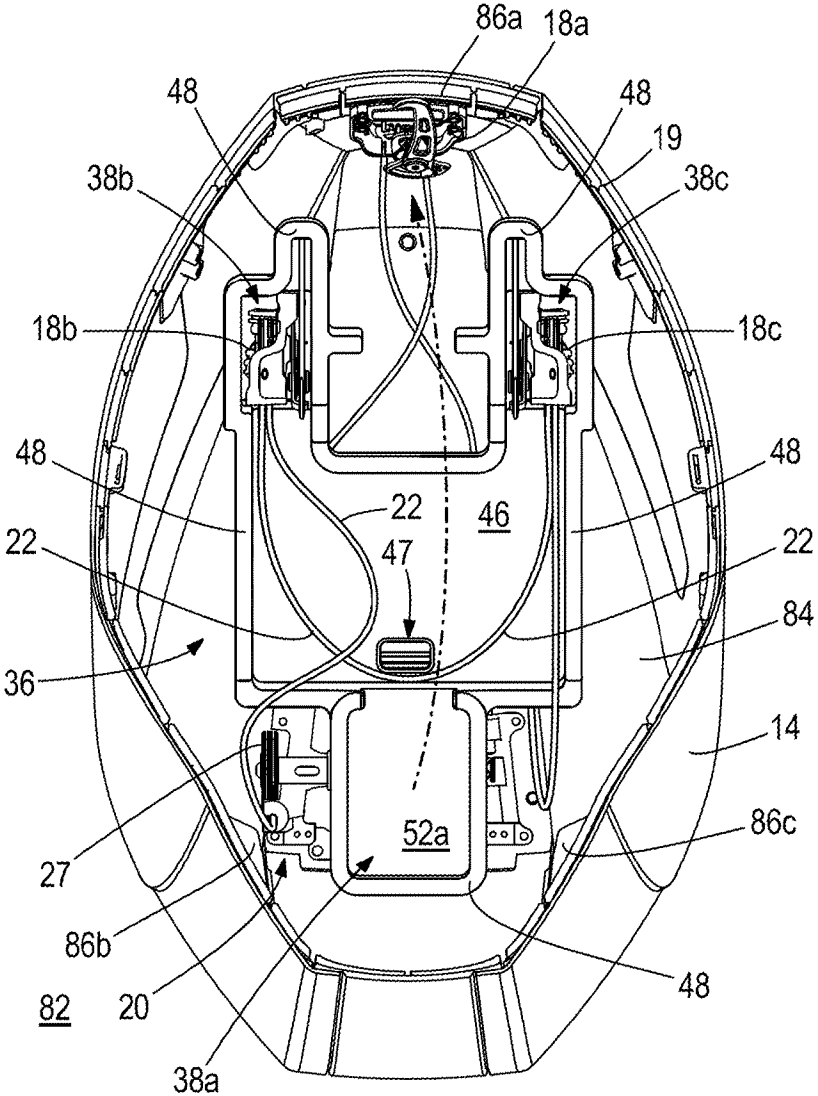
FIG. 8 shows attachment of a first latching device onto the upper cowl portion.

Referring to FIG. 8, the latching device 18*a* is manually removed from the latching device cavity 38*a* and mounted to the mounting fixture 86*a* at the forward side of the upper cowl portion 14 via, for example, fasteners. As can be seen in FIG. 8, the face-up orientation of the latching device 18*a* in the latching device cavity 38*a* facilitates easy transfer to the mounting fixture 86*a* without kinking or tangling the flexible connectors 22.

Figure 9:
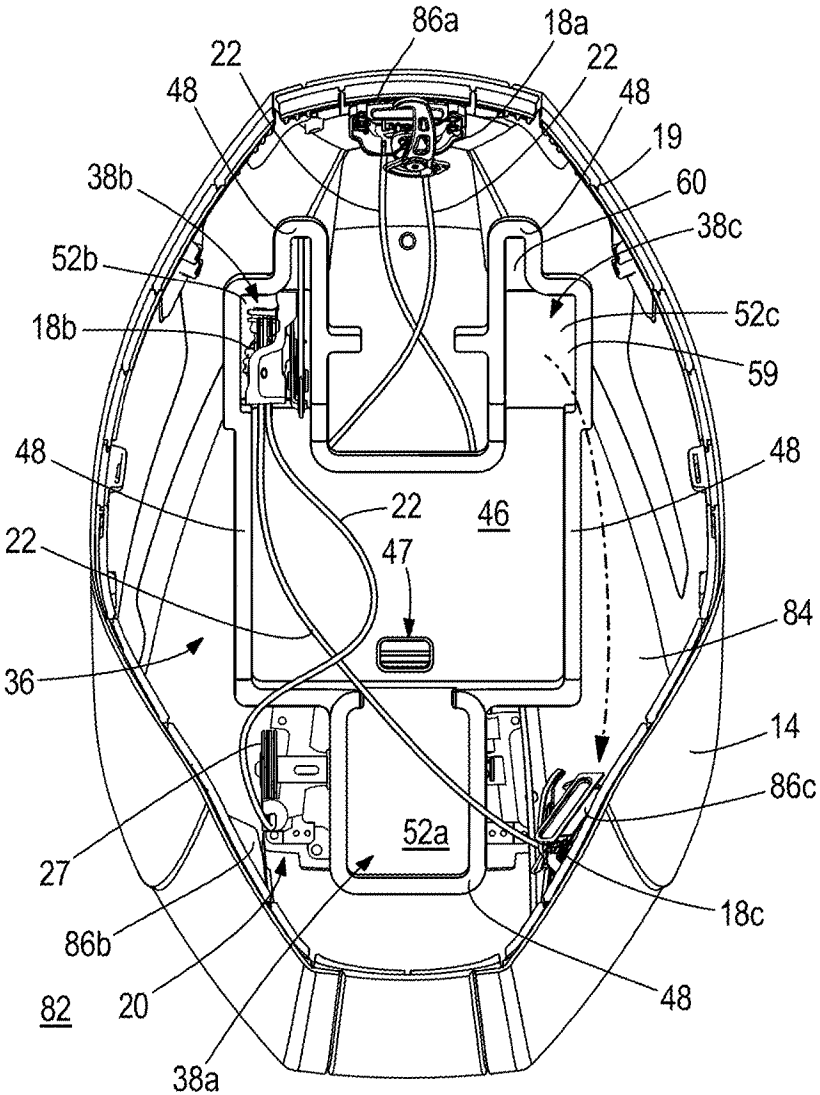
FIG. 9 shows attachment of a second latching device onto the upper cowl portion.
Figure 10:
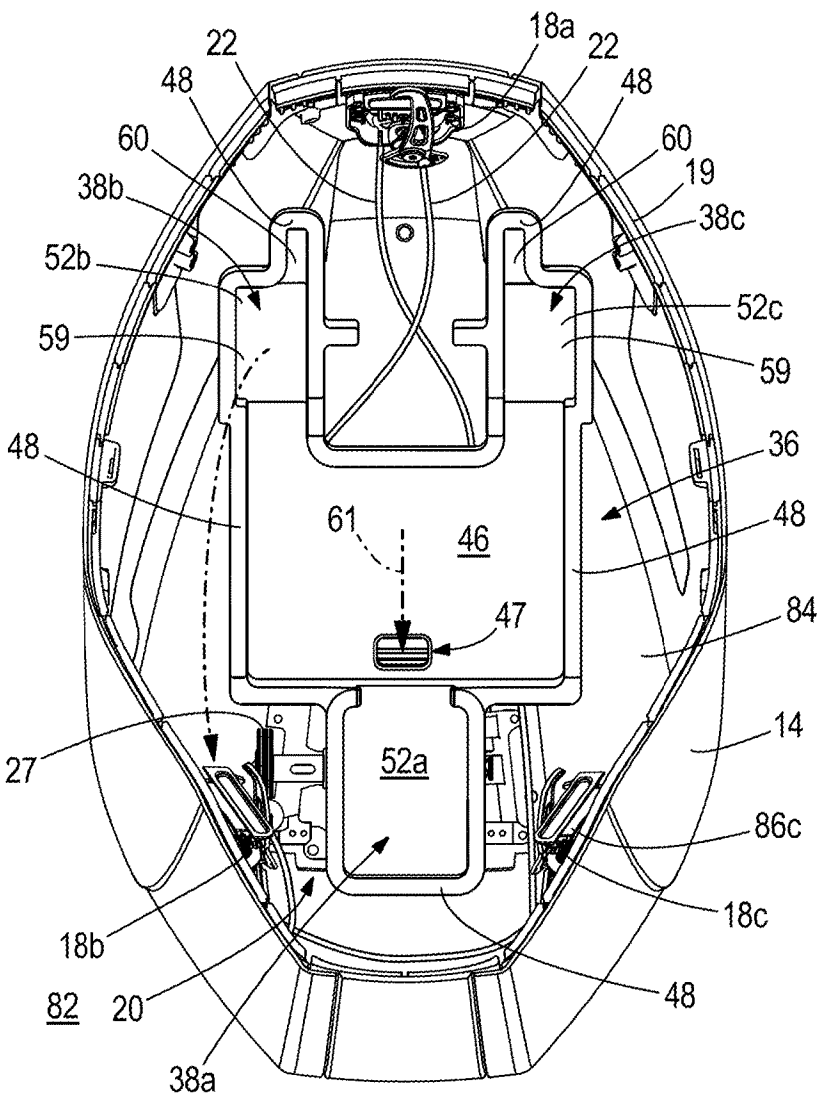
FIG. 10 shows attachment of a third latching device onto the upper cowl portion.

Referring to FIGS. 9 and 10, the latching devices 18*c*, 18*b* are manually removed from the latching device cavities 38*c*, 38*b* and mounted to the respective mounting fixtures 86*c*, 86*b* on the port and starboard sides of the upper cowl portion 14, respectively, via, for example, fasteners. As can be seen in FIGS. 8 and 9, the sideways orientation of the latching devices 18*b*, 18*c* in the latching device cavities 38*b*, 38*c* facilitates easy transfer to the mounting fixtures 86*b*, 86*c* without kinking or tangling the flexible connectors.

Figure 11:
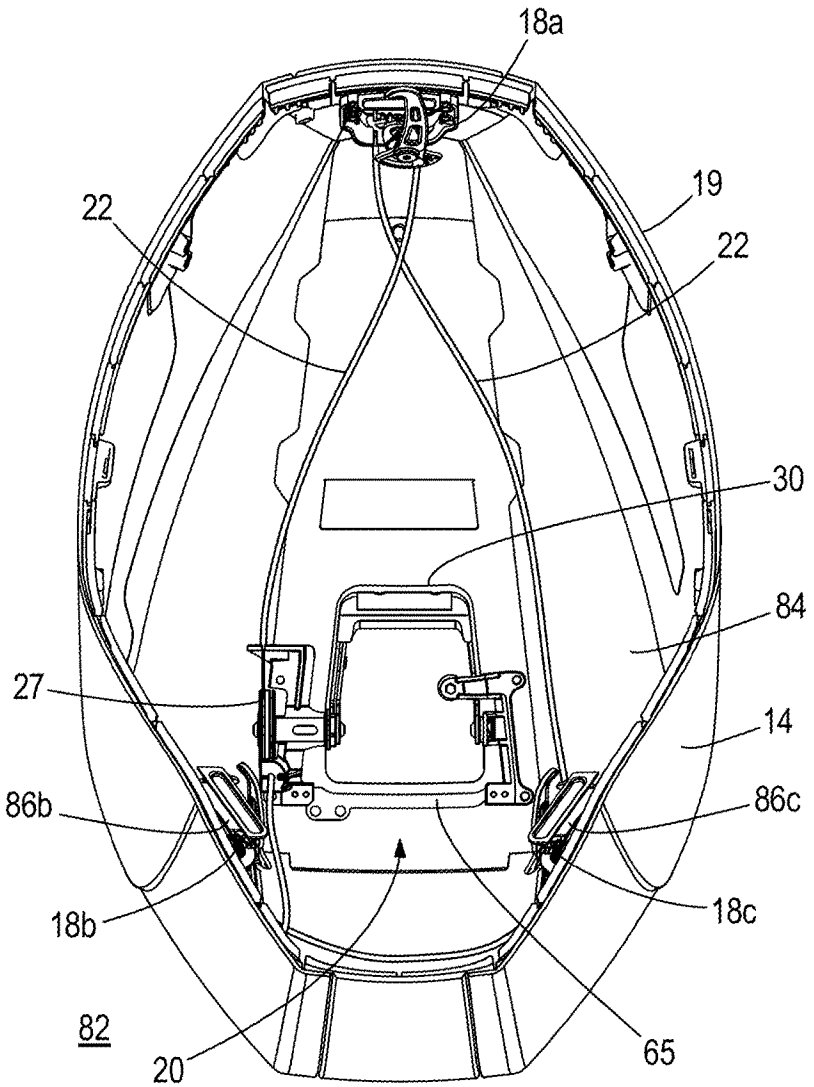
FIG. 11 shows the upper cowl portion and latching assembly after the carrying tray is removed.

Referring to FIGS. 10 and 11, the installer next manually presses on the carrying handle 30 via the aperture 47, as shown at arrow 61, to dislodge the carrying handle 30 from between the handle retaining members 62 and then removes the carrying tray 36 from the upper cowl portion 14. This allows the mounting bracket 65 to separate from the bearing surfaces 66 and leaves the actuator 20 in place for mounting to the interior surface 84 of the upper cowl portion 14 proximate to a mounting fixture by the service door 32.

Thus, the present disclosure provides a means and method for assembling a latching assembly on a cowl of a marine drive, wherein the cowl has a lower cowl portion and an upper cowl portion that mates with the lower cowl portion to enclose the marine drive, and the latching assembly has a plurality of latching devices configured to latch and unlatch the lower cowl portion to the upper cowl portion, an actuator that actuates the latching device, and a plurality of flexible connectors that operatively couple the plurality of latching devices to the actuator. In the examples described herein above, the method includes (1) transporting the latching assembly in a carrying tray having a plurality of latching device cavities that retain the plurality of latching devices in a spaced-apart orientation that positions each respective latching device in the plurality of latching devices with respect to an intended mounting position of the respective latching device on the cowl and an actuator retainer that retains the actuator in a position with respect to an intended mounting position of the actuator on the cowl; (2) placing the carrying tray in the cowl; and (3) sequentially removing the plurality of latching devices and actuator from the carrying tray and mounting the plurality of latching devices and actuator on the cowl. In certain examples, the upper cowl portion is inverted and rested on a support surface and then the carrying tray is placed into the upper cowl portion in the position where the plurality of latching devices and actuator are specifically positioned with respect to their respective intended mounting positions so as to facilitate easy and accurate installation.

In the present description, certain terms have been used for brevity, clearness and understanding. No unnecessary limitations are to be implied therefrom beyond the requirement of the prior art because such terms are used for descriptive purposes only and are intended to be broadly construed. The different systems, methods and apparatuses described herein may be used alone or in combination with other systems, methods and apparatuses. Various equivalents, alternatives and modifications are possible within the scope of the appended claims.

What is claimed is:

1. A method of assembling a latching assembly on a cowl of a marine drive, the cowl having a lower cowl portion and an upper cowl portion that mates with the lower cowl portion to enclose the marine drive, the latching assembly comprising a plurality of latching devices configured to latch and unlatch the lower cowl portion to the upper cowl portion, an actuator that actuates the plurality of latching devices, and a plurality of flexible connectors that operatively couples the plurality of latching devices to the actuator, the method comprising:

(i) transporting the latching assembly in a carrying tray having a plurality of latching device cavities that retains the plurality of latching devices in a spaced-apart orientation that positions each respective latching device with respect to a mounting position of the respective latching device on the cowl so that the respective latching device can be directly installed onto the cowl without tangling or damaging the flexible connectors, and further having an actuator retainer that retains the actuator in a position with respect to a mounting position of the actuator on the cowl so that the actuator can be directly installed onto the cowl without tangling or damaging the flexible connectors;

(ii) placing the carrying tray in the cowl; and (iii) sequentially removing the plurality of latching devices and actuator from the carrying tray and mounting the plurality of latching devices and actuator on the cowl.

2. The method according to claim 1, wherein (ii) comprises inverting the upper cowl portion and resting the upper cowl portion on a support surface and then placing the carrying tray into the upper cowl portion.

3. The method according to claim 2, wherein the mounting positions of the plurality of latching devices are spaced apart around a periphery of the upper cowl portion and wherein the mounting position of the actuator is on top of the upper cowl portion.

4. The method according to claim 3, wherein (iii) comprises first sequentially removing and mounting the plurality of latching devices and then removing and mounting the actuator.

5. The method according to claim 3, further comprising removing the actuator by manually pushing the actuator out of the actuator retainer via an aperture in the carrying tray.

6. The method according to claim 1, wherein the plurality of latching device cavities and actuator retainer are spaced apart from each other by a distance that is sufficient to prevent kinking of the plurality of flexible connectors during transport and storage of the latching assembly and carrying tray.

7. The method according to claim 6, wherein the distance is large enough so that the flexible connectors maintain a minimum radius of curvature during transport and installation of the plurality of latching devices and actuator.

8. The method according to claim 1, wherein the latching device cavities are spaced apart around a periphery of the carrying tray.

9. The method according to claim 8, wherein the plurality of latching devices comprises a first latching device that is retained face-up in the carrying tray and a second latching device that is retained sideways the carrying tray; and wherein (iii) comprises installing the first latching device on first side of the upper cowl portion and installing the second latching device on a second side of the upper cowl portion that is transverse to the first side, without kinking of the plurality of flexible connectors.

10. The method according to claim 1, wherein (iii) comprises manually pushing of the actuator downwardly, out of the actuator retainer when the carrying tray is rested on the mounting position for the actuator.

11. The method according to claim 1, wherein the carrying tray comprises a central base wall and sidewalls that project upwardly and downwardly from the base wall and define an outer extent of the carrying tray, and wherein the central base wall is located between the plurality of latching device cavities and the actuator retainer.

12. The method according to claim 11, wherein (iii) comprises removing the actuator from the carrying tray by manually pushing the actuator out of the actuator retainer via an aperture in the base wall.

13. The method according to claim 11, wherein portions of the sidewalls extend downwardly past the base wall and past the actuator in the actuator retainer, thus facilitating vertical stacking of the carrying tray with a similarly constructed carrying tray, and further comprising prior to (i), vertically stacking and transporting the carrying tray with the similarly constructed carrying tray in a nested arrangement to thereby safely transport a pair of latching assemblies prior to installation.

* * * * *